US006206317B1

(12) United States Patent
Harvestine

(10) Patent No.: US 6,206,317 B1
(45) Date of Patent: Mar. 27, 2001

(54) APPARATUS AND METHOD FOR COILING A FIRE HOSE

(75) Inventor: Ronold L. Harvestine, Hartland, WI (US)

(73) Assignee: Lake Area Fire Equipment Company, Inc., Hartland, WI (US)

( * ) Notice: Subject to any disclaimer, the term of this patent is extended or adjusted under 35 U.S.C. 154(b) by 0 days.

(21) Appl. No.: 09/299,042

(22) Filed: Apr. 23, 1999

(51) Int. Cl.[7] ..... B65H 75/30

(52) U.S. Cl. ..... 242/395; 242/403; 242/406; 242/532.6

(58) Field of Search ..... 242/395, 403, 242/406, 532.6; 137/355.16, 355.19; 254/323

(56) References Cited

U.S. PATENT DOCUMENTS 1,089,265 * 3/1914 Ridley .
2,396,451 * 3/1946 Warkentin .
3,058,688 * 10/1962 Abel .
3,124,321 * 3/1964 Rylott et al. .
3,168,260 * 2/1965 Kittelson .
3,779,478 * 12/1973 Fugate .
3,946,964 * 3/1976 Zinser .
4,198,010 * 4/1980 Knapp .
4,265,414 * 5/1981 Sprading .
4,266,740 * 5/1981 Ramos et al. .
4,280,672 * 7/1981 Santos et al. .
4,288,047 * 9/1981 Berry et al. .
5,205,509 * 4/1993 Noggle .
5,308,011 * 5/1994 Roman .
5,505,404 * 4/1996 Dubreuil .
5,566,901 * 10/1996 Wilder .
5,961,061 * 10/1999 Stanley .
5,988,559 * 11/1999 Gnass .

* cited by examiner

*Primary Examiner*—Donald P. Walsh
*Assistant Examiner*—William A. Rivera
(74) *Attorney, Agent, or Firm*—Nilles & Nilles, S.C.

(57) ABSTRACT

An apparatus for coiling a fire hose includes a base and a main support extending generally vertically and having upper and lower opposed ends, the lower end being attached to the base. The upper end includes a hose reel having an axle that is rotatably mounted to the upper end and which has an axle distal end. A crank is coupled to the axle of the hose reel to rotate the hose reel as the crank is correspondingly rotated. The crank has first and second opposed ends, the first end being releasably coupled to the axle distal end and the second end being configured to be gripped by a user. Next, the apparatus includes a retainer for coupling the fire hose to the hose reel, retainer including a handle and a pair of elongated rods that are spaced. To operate the apparatus, a portion of the fire hose near the male hose end is positioned between the elongated rods of the retainer, and then the retainer is coupled to the hose reel. By rotating the crank, the hose reel correspondingly rotates to uniformly coil the fire hose thereon. Thereafter, by removing the retainer, the coiled hose drops onto a catcher for support, such that the coiled hose may be removed for further transport and/or storage.

21 Claims, 5 Drawing Sheets

APPARATUS AND METHOD FOR COILING A FIRE HOSE

BACKGROUND OF THE INVENTION

1. Field of the Invention

The present invention is directed to an apparatus and method for efficiently coiling a fire hose for subsequent transport or storage, and more particularly to a completely modular and portable apparatus that allows for ready removal of the coiled fire hose from the apparatus, and that is adapted to be mounted either onto a vehicle or at a remote location in a free-standing configuration.

2. Description of the Related Art

Fire hoses are heavy, large articles that are difficult to roll up in a uniform fashion. This operation becomes even more difficult when it is desired to roll the hose at locations remote from where they are stored.

Available fire hose rolling equipment is typically bulky and heavy, and therefore difficult to set up and transport. The components of these systems are typically large and awkward to handle, and require a significant amount of hardware for assembly. One known system includes a plurality of large circular members that include coupling portions that have to be properly aligned prior to sandwiching the fire hose therebetween. The circular members have a large diameter and include a handle that is typically attached to an outer one of the members, near its rim, thus requiring that the user be big enough to comfortably crank the handle. Even so, users often have difficulty ensuring that the hose rolls up in uniform fashion due to the hose having a tendency to unravel when rolling it up.

Further, in addition to being relatively difficult to set up for use, the apparatus must be secured to a mounting bracket attached to, e.g., a vehicle. Typically, the apparatus has no utility separate from its mounting bracket, thus unacceptably limiting its flexibility for use at remote locations. And, once the hose is rolled up, removing the hose from the apparatus becomes at times a difficult task, and more often, an inefficient one. The user must attempt to grab the rolled up hose and then inconveniently pull the outer one of the circular members away from the remainder of the apparatus. This operation can cause the user to drop the hose, or can cause the hose to unravel from its center if the circular member catches a portion of the hose, a problem exacerbated by the fact that the hose is heavy and clumsy. In either case, the operation must be repeated. Overall, known equipment for coiling fire hose has limited flexibility, typically causes the user to suffer fatigue during use and is generally inconvenient to operate, often times being overly time-consuming.

As a result, the field of coiling fire hoses is in need of an apparatus that is easy to use, completely modular for ready storage and transport, permits removal of the hose without difficulty, can be efficiently disassembled with a minimum of hardware, and is readily usable at remote locations.

OBJECTS AND SUMMARY OF THE INVENTION

The present invention is directed to a fire hose coiling apparatus for efficiently and conveniently coiling a fire hose including a plurality of easy to operate components that can be assembled with a minimum amount of hardware. The apparatus is entirely modular, easy to assembly/disassemble, portable and usable either in a free-standing configuration or as mounted to, for example, a vehicle.

According to one aspect of the invention, the apparatus for coiling a fire hose includes a base and a main support extending generally vertically and having upper and lower opposed ends, the lower end being attached to the base. The upper end includes a hose reel having an axle that is rotatably mounted to the upper end and which has an axle distal end. A crank is coupled to the axle of the hose reel to rotate the hose reel as the crank is correspondingly rotated. The crank has first and second opposed ends, the first end being releasably coupled to the axle distal end and the second end being configured to be gripped by a user. Next, the apparatus includes a retainer for coupling the fire hose to the hose reel, retainer including a handle and a pair of elongated rods that are spaced. To operate the apparatus, a portion of the fire hose near the male hose end is positioned between the elongated rods of the retainer, and then the retainer is coupled to the hose reel. By rotating the crank, the hose reel correspondingly rotates to uniformly coil the fire hose thereon. Notably, the apparatus is elevated such that residual water contained in the hose is dispensed from the hose as the user coils the hose.

According to a further aspect of the invention, the apparatus includes a hub attached to the upper end of the main support, the hub being configured to rotatably receive an axle distal end of the axle. Preferably, the hub is mounted at an angle relative to a generally horizontal plane to facilitate even rolling of the hose.

According to a still further aspect of the invention, the apparatus includes a catcher releasably attached to the main support below the hose reel, and extending generally horizontally relative to the main support. The catcher operates to support the fire hose once the hose has been coiled and the retainer is decoupled from the hose reel. The catcher preferably includes a horizontal support attached to a main support and a generally U-shaped portion attached to the horizontal support that has a pair of arms mutually spaced from the horizontal support.

According to another aspect of the invention, the base includes a coupler and a plurality of mutually spaced legs attached to the coupler to elevate and stabilize the apparatus in a free-standing configuration. Alternatively, the base includes a bracket having a first base end attached to a vehicle bracket (e.g., a trailer hitch), and a second base end attached to the lower end of the main support.

A method of coiling a fire hose is also disclosed and includes the steps of using a fire hose rolling apparatus as described above. The method also includes the step of placing at least a portion of the fire hose between the pair of elongated rods of the retainer and then inserting the rod distal ends of the pair of spaced rods of the retainer into the pair of spaced openings of the cross support of the hose reel. Thereafter, the user rotates the crank so as to cause the fire hose to coil to create a coiled fire hose. Finally, the user removes the retainer from the pair of spaced openings so as to cause the coiled fire hose to drop onto the catcher for subsequent removal therefrom.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE INVENTION

Figure 1:
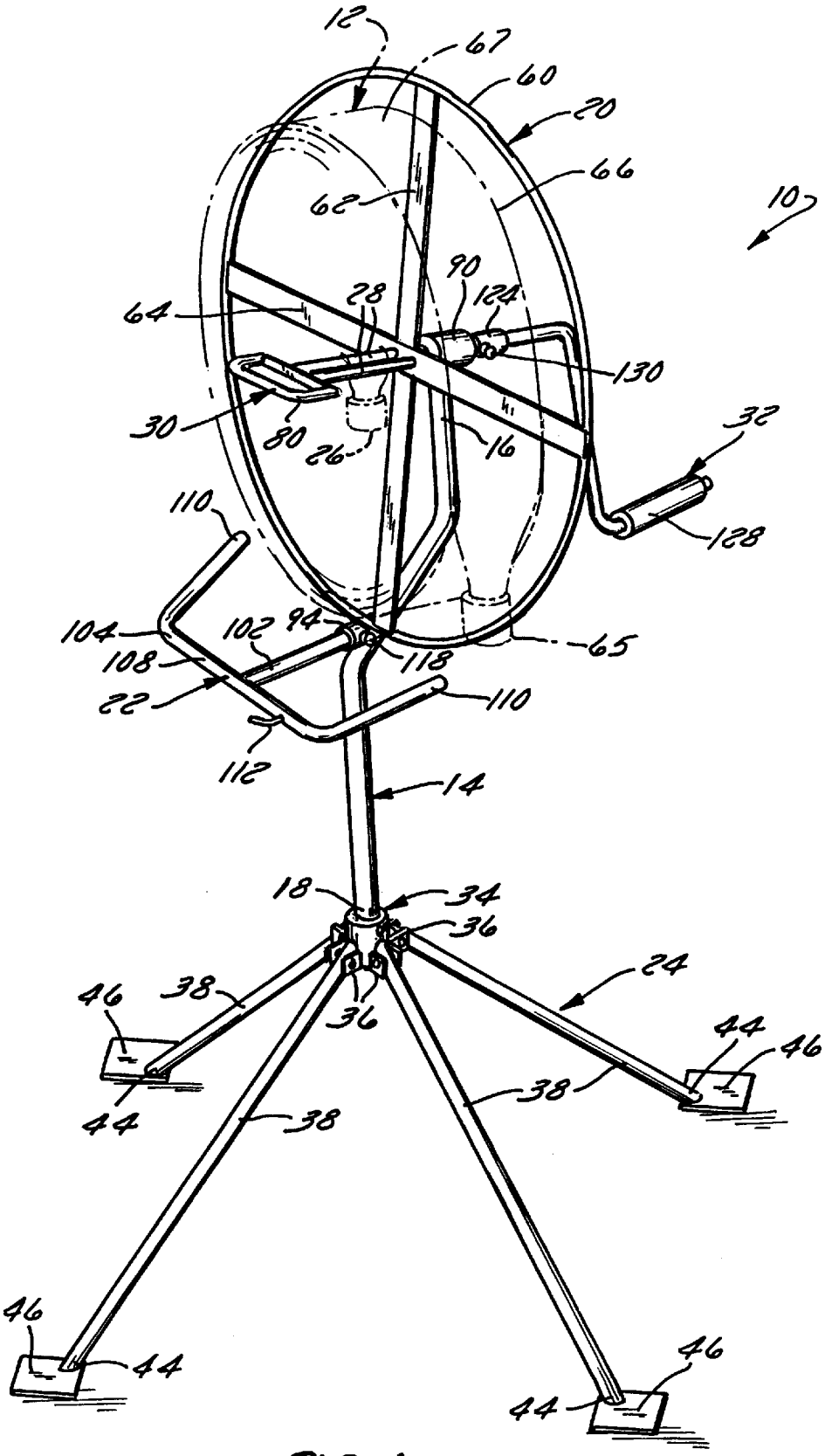
FIG. 1 is a perspective view of a fire hose coiling apparatus according to the present invention.

Referring initially to FIG. 1, a free-standing apparatus 10 for coiling a fire hose 12 includes a main support 14 extending vertically and having upper and lower opposed ends 16, 18, respectively, a hose reel 20, a catcher 22, and a crank 32. As described in further detail below, by placing a hose end 26 (preferably, the male end) of the fire hose 12 between a pair of rods 28 of a retainer 30, coupling retainer 30 to hose reel 20, and turning a crank 32 attached thereto, the hose can be readily and efficiently coiled onto rods 28 and hose reel 20. Thereafter, by removing retainer 30 from hose reel 20, fire hose 12 is dropped onto catcher 22 for further transport and/or storage.

Figure 2:
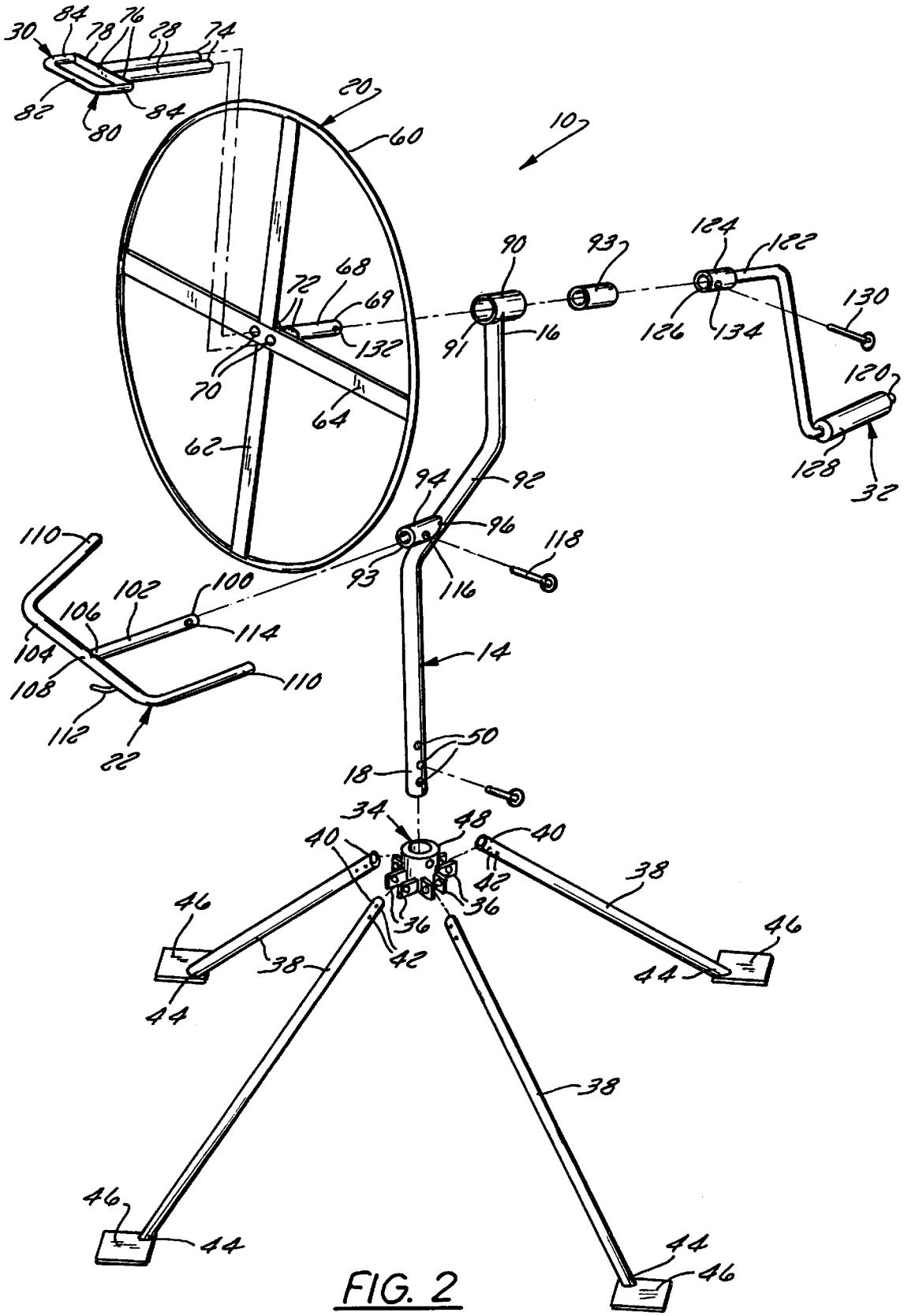
FIG. 2 is an exploded perspective view of the apparatus of FIG. 1.

Referring more generally to FIGS. 1 and 2, the free-standing embodiment of fire hose coiling apparatus 10 includes a base 24 for elevating and stabilizing the apparatus. Base 24 includes a coupler 34 having a generally vertical longitudinal axis and which includes a plurality of mutually spaced brackets 36 attached thereto. Brackets 36 are generally L-shaped and different pairs of brackets 36 are adapted to couple corresponding ones of a plurality of legs 38, legs 38 being included to elevate and stabilize hose reel 20 of apparatus 10. Legs 38 are preferably elongated rods having a first end 40 including a plurality of holes 42 formed therein for attaching legs to brackets with fasteners (preferably ¼-20 bolts with lock nuts or locking pins), and a second end 44 to which is attached a corresponding foot 46 for providing stability to legs 38 and, more generally, base 24. Preferably, base 24 includes four L-shaped brackets 26 and four legs 38 to optimize stability. Notably, base 24, like the remainder of apparatus 10, can be assembled/disassembled in a brief amount of time for convenient use, transport and/or storage.

Coupler 34 is configured to receive lower end 18 of main support 14 and includes a hole 48 formed therein, transverse to the longitudinal axis of coupler, for securing main support 14 to coupler 34. More particularly, lower end 18 of main support 14 includes a plurality of adjustment holes 50 that are configured to correspond to hole 48 of coupler 34 such that, when aligned, holes 48, 50 can collectively receive a corresponding locking pin 52 to secure main support 14 to base 24. As such, the apparatus 10 is adjustable to a user's desired height. When assembled, the longitudinal axis of coupler 34 is coaxial with the longitudinal axis of main support 14 at its lower end 18.

Next, hose reel 20 includes a rim 60 and first and second cross supports 62, 64, respectively, having opposed ends attached to rim 60 such that cross supports 62, 64 generally extend through the center of rim 60. Hose reel 20 also includes an axle 68 that is attached to first cross support 62 generally at the center of first cross support 62 and perpendicularly thereto. Second cross support 64, which is preferably disposed perpendicularly to first cross support 62, includes a pair of holes 70 formed therein which are disposed, generally, on either side of its center. Further, a pair of tubular bosses 72 (see FIGS. 2 and 3) are attached to second cross support 64 and are disposed generally coaxially with holes 70 of second cross support 64. Bosses 72 accommodate retainer 30 during operation.

Figure 3:
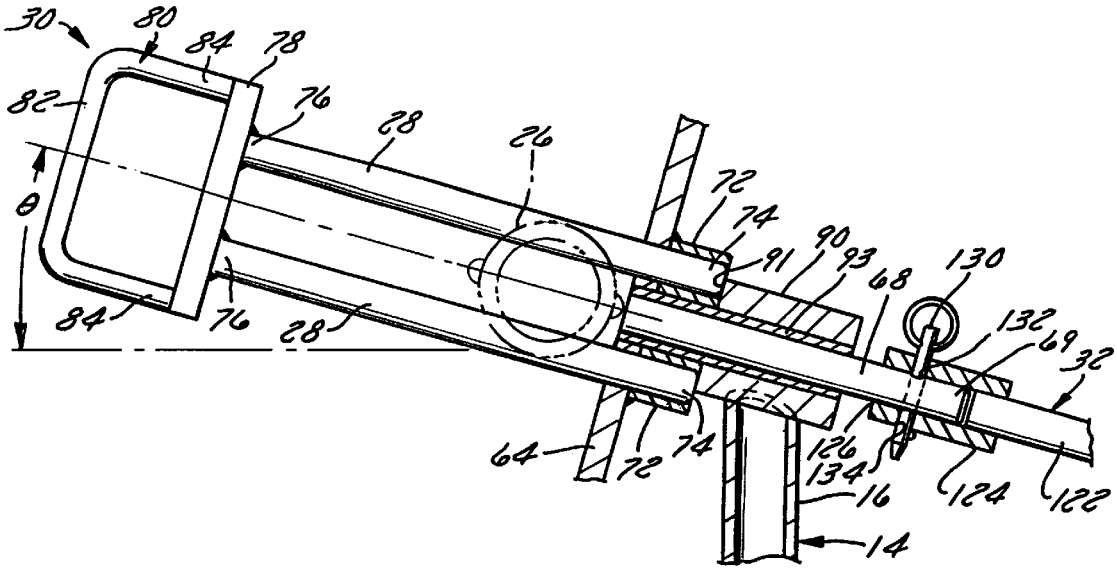
FIG. 3 is a partially broken away, cross-sectional side elevational view of a retainer coupled to a hose reel of the apparatus of FIG. 1.

With particular reference to FIGS. 2 and 3, holes 70 and corresponding coaxial bosses 72 of hose reel 20 are sized to receive a corresponding pair of rod distal ends 74 of spaced elongated rods 28 of retainer 30. Opposite rod distal ends 74 are fixed ends 76 which are attached to a cross bar 78 of a handle 80. Handle 80 also includes a U-shaped portion 82 adapted to be gripped by a user and which includes a pair of distal ends 84 (FIG. 3) which are fixed to cross bar 78 for ready insertion and removal of retainer 30 into/out of holes 70 and corresponding bosses 72 of second cross support 64.

A hub 90 is attached to upper end 16 of main support 14. Hub 90 is preferably tubular and configured to receive an axle distal end 69 of axle 68 of hose reel 20 and allow axle 68 to rotate with respect thereto. More particularly, mounted coaxially within hub 90 is a bushing 93 which is preferably an oil impregnated bronze bushing to aid the ease with which axle 68 rotates relative to hub 90. Further, hub 90 is preferably attached to main support 14 at an angle $\theta$ (see FIG. 3) such that, when coiling hose 12, gravity works to keep hose 12 coiling in an even, uniform fashion, i.e., without radial portions of the "coiling hose" unraveling from its center. Angle $\theta$ should be chosen to be large enough to ensure that at least a portion of the inner edge 66 of hose 12 abuts first and second cross supports 62, 64 of hose reel 20 during winding, yet not so large so as to interfere with the ease with which the user can operate crank 32 (described below).

Intermediate upper and lower ends 16, 18, respectively, of main support 14 is a midsection 92. Midsection 92 is angled relative to the longitudinal axis of coupler 34 and lower end 18 of support 14 such that the longitudinal axes of main support at its upper and lower ends 16, 18, respectively, are generally parallel, yet displaced. Midsection 92 includes a generally cylindrical mount 94 having a proximal end 96 attached to the midsection. Mount 94 extends in a generally horizontal plane and includes a female distal end 92 for receiving an attachment end 100 of a horizontal support 102 of catcher 22.

Catcher 22 of apparatus includes horizontal support 102 and a U-shaped portion 104 attached to a fixed end 106 of horizontal support 102. Opposite fixed end 106 of horizontal support 102 is attachment end 100 that has hole 114 formed therein which corresponds to an associated hole 116 formed in mount 94, preferably transverse to the longitudinal axis of mount 94. Once inserted into mount 94, horizontal support 102 of catcher 22 can be locked to mount 94 with a locking pin 118. Further, generally U-shaped portion 104 of catcher 22 includes a cross member 108 and a pair of arms 110 attached to opposed ends of cross member 108 such that arms are mutually spaced from horizontal support 102. Most generally, catcher 22 operates to support hose 12 after performing a coiling operation and removing retainer 30 from hose reel 20, as described in further detail below in conjunction with FIGS. 4A–4C.

U-shaped portion 104 of catcher 22 also includes a hook 112 that is attached to and extends generally outwardly from cross member to hang retainer 30 when the coiling operation is complete. Also, U-shaped portion 104 of catcher 22 preferably is attached to horizontal support 102 such that arms 110 extend upwardly at an angle $\alpha$ to a horizontal plane. Notably, the angle $\alpha$ is preferably approximately equal to the angle $\theta$ at which hub 90 is mounted to upper end 16 of main support 14 to ensure that the coiled hose 12 drops securely onto catcher 22.

With further reference to FIG. 2, crank 32 includes a gripping end 120 and an opposed attachment end 122 to which is attached (e.g., welded) a collar 124. Collar 124 is generally tubular and has a fixed end attached to crank 32, and a female end 126 configured to receive axle distal end 69. Gripping end 120 preferably includes a grip 128 which may be made of, e.g., a steel DOM tube that is mounted on gripping end 120 so as to allow grip 128 to spin, thus facilitating ease of operation.

To assemble apparatus 10, after anchoring main support 14 to base 24, hose reel 20 and crank 32 can be readily coupled to main support 14. Axle distal end 69 is inserted into hub 90 until bosses 72 of second cross support 64 abut a forward face 91 of hub 90. Then, female end 126 of collar 124 is fed onto axle distal end 69 and a locking pin 130 is inserted into corresponding holes 132, 134 of crank 32 and axle 68, respectively, to lock the crank to the axle. As a result, when turning crank 32, hose reel 20 correspondingly rotates.

Figure 4B:
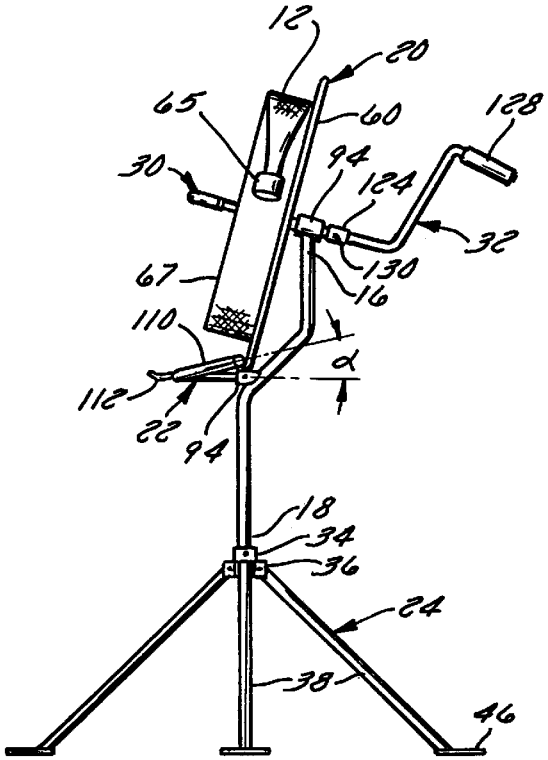
FIGS. 4A–4C are side elevational views of the apparatus of FIG. 1, illustrating the coiling and removal of a fire hose.
Figure 4A:
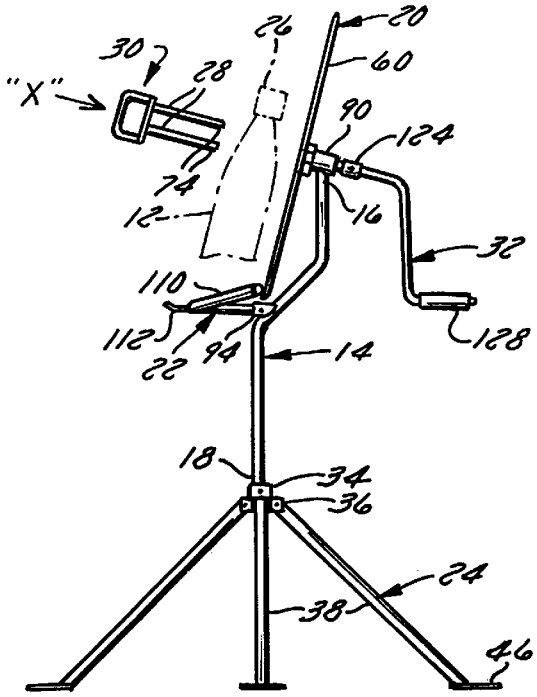

To operate the fire hose coiling apparatus 10, the user initially places the hose body 67, near the male coupling end 26 of fire hose 12, between elongated rods 28 of retainer 30, as shown in FIG. 1. Next, turning to FIGS. 4A–4C, with male coupling end 26 of hose 12 on retainer 30, rod distal ends 74 of retainer 30 are inserted, in a direction "X", into the holes 70 of second cross support 64 of hose reel 20, and further into bosses 72 until, preferably, distal ends 74 abut face 91 of hub 90 (FIGS. 3 and 4A). Thereafter, as shown in FIG. 4B, the user grips gripping end 128 of crank 32 and turns crank 32 (in either direction, whichever is most convenient for the user) to cause fire hose 12 to coil onto itself. As the user continues to rotate crank 32, the inside edge 66 (FIGS. 1 and 4B) of hose 12 abuts first and second cross supports 62, 64, respectively. As mentioned previously, because hub 90 is mounted at an angle θ to allow gravity to keep the inside edge 66 of fire hose 12 against supports 62, 64, hose 12 coils generally in a uniform fashion. As the user continues to rotate the crank 32, while any water remaining in hose 12 is pushed outwardly towards the nozzle 65 due to hose reel 20 being elevated from the ground and the coiling action of the apparatus. When complete, fire hose 12 is evenly coiled on hose reel 20 and a majority of the residual water is dispensed therefrom.

Figure 4C:
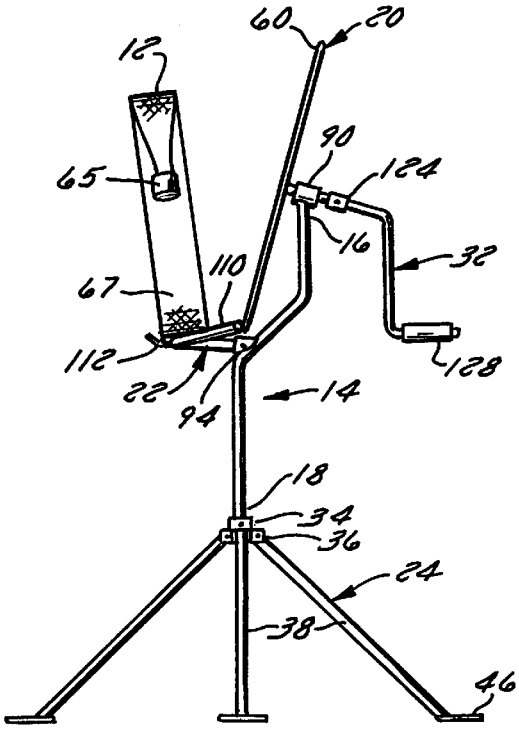

Turning to FIG. 4C, the user then removes retainer 30 from hose reel 20 and allows the coiled fire hose to drop onto arms 110 of catcher 22, with hose reel 20 still acting as a backing to prevent hose 12 from falling to the ground. Finally, retainer 30 can be placed on hook 112 and hose 12 can be removed from catcher 22 for further transport and/or storage. The user can then break down fire hose coiling apparatus 10, and conveniently store the apparatus for future use.

Figure 5:
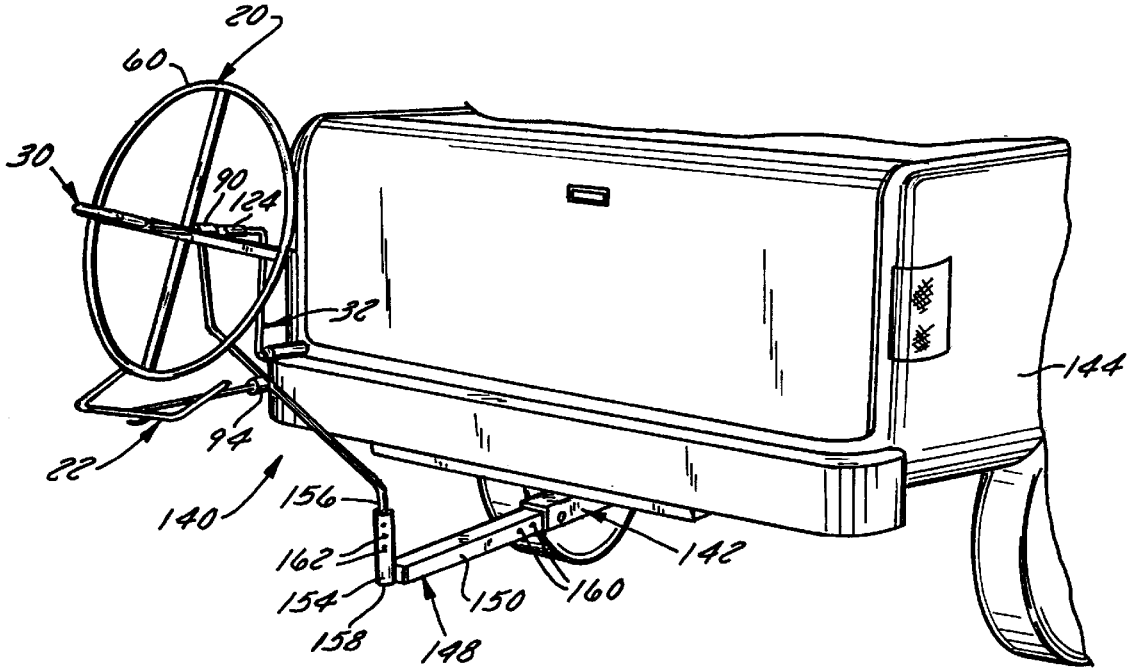
FIG. 5 is a perspective view of an alternate embodiment of the base of a fire hose coiling apparatus according to the present invention shown mounted to a vehicle.
Figure 6:
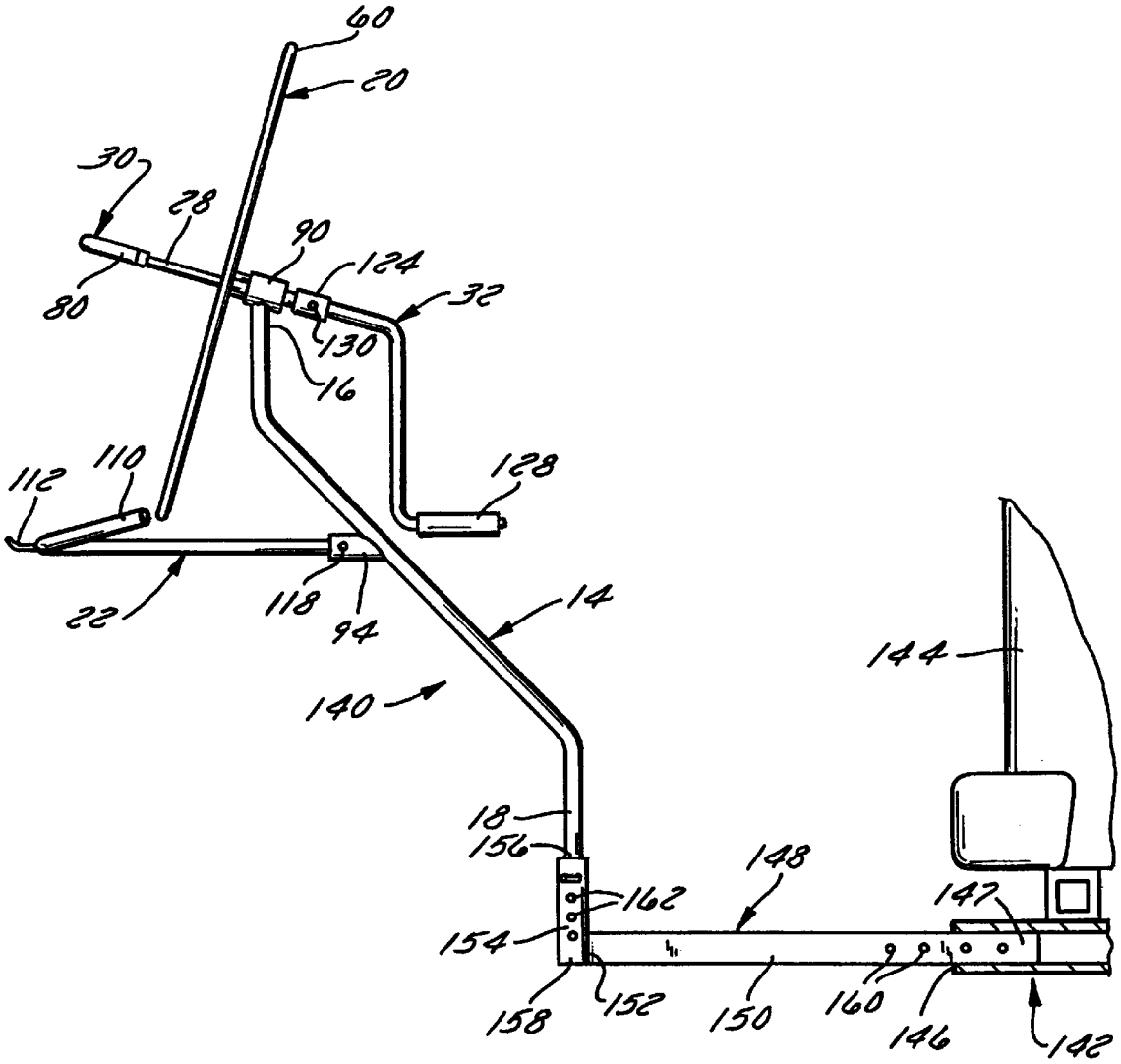
FIG. 6 is a partially broken away side elevational view of the alternative embodiment of the base shown in FIG. 5.

Turning to FIGS. 5 and 6, an alternate embodiment of base 24 of fire hose coiling apparatus is shown at 140. In particular, a vehicle bracket 142 (e.g., a tubular trailer hitch) attached to a vehicle 144 and having a female end 146 is adapted to receive a male first base end 147 of a, preferably, L-shaped support bracket 148 of base 140. Support bracket 148 includes a horizontal mounting support 150 which is preferably tubular to accommodate, e.g., a trailer hitch, and includes an attachment end 152, opposite first base end 147. Attachment end 152 is coupled to a vertical mounting support 154 that extends generally upwardly and which includes a female second base end 156, opposite fixed end 158, for receiving lower end 18 of main support 14 of the fire hose coiling apparatus.

First base end 147 of horizontal support 150 includes a plurality of holes 160 each of which is adapted to align with a corresponding hole of vehicle bracket 142 and which are preferably mutually spaced. Holes 160 are configured to receive a pin for securing base 140 of the fire hose coiling apparatus to vehicle 144, thus permitting the user to readily adjust the position of apparatus 10 relative to vehicle 144. Second base end 156 of vertical mounting support 154 likewise includes a plurality of holes 162 corresponding to holes 50 in lower end of main support 14 for adjustably locking main support 14 to vertical mounting support 154 of bracket 148. A locking pin is similarly used to secure main support 14 to base 140, thus allowing the user to place apparatus 10 at a desired height.

All components of apparatus 10 are preferably made of solid steel to maximize the strength of the system, while supports 150, 154 of base 140 are preferably made of tubular steel of similar strength. Further, as described previously, all couplings are preferably quick-lock devices (e.g., hole/locking pin) to facilitate quick assembly/disassembly of the apparatus.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. For instance, although crank 32 is shown and described as preferably being manually operable, most notably for cost considerations associated with the apparatus, crank 32 may alternatively be a motor controlled crank to further facilitate ease of operation. In sum, many changes and modifications may be made within the scope of the present invention without departing from the spirit thereof, and the invention includes all such modifications.

What is claimed is:

1. An apparatus for coiling a fire hose, the apparatus comprising:

a main support extending generally vertically and having upper and lower opposed ends, wherein said lower end is attached to said base;

a hose reel having an axle, said axle rotatably mounted to said upper end of said main support and having an axle distal end;

a crank having first and second opposed ends, wherein said first end is coupled to said axle distal end and said second end is configured to be gripped by a user for rotating said crank;

a retainer to couple the fire hose to said hose reel, said retainer including a handle and a pair of elongated rods each having a proximal end attached to said handle and a rod distal end opposite said proximal end, wherein said retainer is slidably removable from the apparatus relative to and independent of the fire hose when the fire hose is coiled on the apparatus; and wherein the fire hose has a hose coupling end including a rim defining a first diameter, and said pair of elongated rods are spaced a perpendicular distance less than the first diameter so as to prevent the hose coupling end from slipping out between the rods in a direction transverse to the length of said elongated rods.

2. A fire hose coiling apparatus according to claim 1, further including a hub attached to said upper end of said main support and configured to rotatably receive said axle.

3. A fire hose coiling apparatus according to claim 2, further including a bushing coaxially mounted to said hub to facilitate the ease with which said axle rotates relative to said hub.

4. A fire hose coiling apparatus, according to claim 1, wherein said hose reel includes a hoop having a second diameter, and a cross support having (1) a length generally equal to the second diameter and (2) opposed ends attached to said hoop.

5. A fire hose coiling apparatus according to claim 4, wherein said axle is attached to said cross support and extends generally perpendicularly to said cross support.

6. A fire hose coiling apparatus according to claim 1, wherein said main support is height adjustable.

7. A fire hose coiling apparatus according to claim 1, wherein said base includes (1) a coupler, and (2) a plurality of mutually spaced legs attached to said coupler to elevate and stabilize the apparatus.

8. A fire hose coiling apparatus according to claim 1, wherein said base includes a bracket having a first base end attached to a vehicle bracket and a second base end attached to said lower end.

9. A fire hose coiling apparatus according to claim 8, wherein said bracket includes (1) a horizontal mounting support defining said first base end, wherein said first base end is configured to be adjustably attached to the vehicle bracket, and (2) a vertical mounting support defining said second base end and being attached to said horizontal mounting support, wherein said second base end is configured to be adjustably attached to said lower end of said main support.

10. An apparatus for coiling a fire hose, the apparatus comprising:

a base:

a main support extending generally vertically and having upper and lower opposed ends, wherein said lower end is attached to said base;

a hose reel having an axle, said axle rotatable mounted to said upper end of said main support and having an axle distal end;

a crank having first and second opposed ends, wherein said first end is coupled to said axle distal end and said second end is configured to be gripped by a user for rotating said crank;

a retainer to couple the fire hose to said hose reel, said retainer including a handle and a pair of elongated rods each having a proximal end attached to said handle and a rod distal end opposite said proximal end;

a hub attached to said upper end of said main support and configured to rotatably receive said axle; and wherein said hub is mounted at an angle relative to a generally horizontal plane to facilitate generally uniform rolling of the hose.

11. An apparatus for coiling a fire hose, the apparatus comprising:

a base;

a main support extending generally vertically and having upper and lower opposed ends, wherein said lower end is attached to said base;

a hose reel having an axle, said axle rotatably mounted to said upper end of said main support and having an axle distal end;

a crank having first and second opposed ends, wherein said first end is coupled to said axle distal end and said second end is configured to be gripped by a user for rotating said crank;

a retainer to couple the fire hose to said hose reel, said retainer including a handle and a pair of elongated rods each having a proximal end attached to said handle and a rod distal end opposite said proximal end;

wherein the fire hose has a hose coupling end including a rim defining a first diameter, and said pair of elongated rods are spaced a perpendicular distance less than the first diameter so as to prevent the hose coupling end from sliping out between the rods in a direction transverse to the length of said elongated rods;

wherein said hose reel includes a hoop having a second diameter, and a cross support having (a) a lend generally equal to the second diameter and (2) opposed ends attached to said hoop;

wherein said axle is attached to said cross support and extends generally perpendicularly to said cross support; and a second cross support having (1) a length generally equal to the second diameter, (2) opposed ends attached to said hoop, and (3) a pair of holes formed therein, each hole being configured to receive a corresponding one of said rod distal ends.

12. A fire hose coiling apparatus according to claim 11, wherein said first and second cross supports are disposed generally perpendicularly to each other.

13. An apparatus for coiling a fire hose, the apparatus comprising:

a base;

a main support extending generally vertically and having upper and lower opposed ends, wherein said lower end is attached to said base;

a hose reel having an axle, said axle rotatably mounted to said upper end of said main support and having an axle distal end;

a crank having first and second opposed ends, wherein said first end is coupled to said axle distal end and said second end is configured to be gripped by a user for rotating said crank;

a retainer to couple the fire hose to said hose reel, said retainer including a handle and a pair of elongated rods each having a proximal end attached to said handle and a rod distal end opposite said proximal end;

wherein the fire hose has a hose coupling end including a rim defining a first diameter, and said pair of elongated rods are spaced a perpendicular distance less than the first diameter so as to prevent the hose coupling end from slipping out between the rods in a direction transverse to the length of said elongated rods; and a catcher attached to said main support below said hose reel and extending generally horizontally relative to said main support, wherein said catcher supports the fire hose once the hose has been coiled and said retainer is decoupled from said hose reel.

14. A fire hose coiling apparatus according to claim 13, wherein said catcher includes (1) a horizontal support attached to said main support and (2) a generally U-shaped portion attached to said horizontal support and having a pair of arms mutually spaced from said horizontal support.

15. A fire hose coiling apparatus according to claim 14, wherein said arms are disposed at about said angle relative to the generally horizontal plane.

16. An apparatus for coiling a fire hose, the apparatus comprising:

a support;

a hose reel rotatably coupled to said support at an angle relative to a generally horizontal plane, said hose reel including (1) a rim defining a diameter, (2) a cross support having a length generally equal to the diameter and having opposed ends attached to said rim, and (3) an axle coupled to said cross support and having an axle distal end;

a retainer to couple the fire hose to said hose reel, said retainer including a handle and a pair of elongated rods each elongated rod having a proximal end attached to said handle and a rod distal end opposite said proximal end; and wherein the fire hose has a hose end including a rim defining a diameter, and said pair of elongated rods are spaced a perpendicular distance less than the diameter so as to prevent the hose coupling end from slipping out between the rods in a direction transverse to the length of said elongated rods.

17. An apparatus for coiling a fire hose according to claim 16, further including a base, wherein said base includes (1) a coupler and (2) a plurality of mutually spaced legs attached to said coupler to elevate and stabilize the apparatus.

18. A fire hose coiling apparatus according to claim 16, further including a base wherein said base includes an L-bracket having a first base end attached to a vehicle bracket and a second base end to which said support is adjustably attached.

19. An apparatus for coiling a fire hose, the apparatus comprising:

a support;

a hose reel rotatably coupled to said support said hose reel including (1) a rim defining a diameter, (2) a cross support having a length generally equal to the diameter and having opposed ends attached to said rim, and (3) an axle coupled to said cross support and having an axle distal end;

a crank coupled to said hose reel to rotate said hose reel;

a retainer to couple the fire hose to said hose reel, said retainer including a handle and a pair of elongated rods each elongated rod having a proximal end attached to said handle and a rod distal end opposite said proximal end;

a catcher attached to said support and extending generally horizontally, wherein said catcher supports the fire hose after the hose has been coiled and said retainer is decoupled from said hose reel; and wherein the fire hose has a hose end including a rim defining a diameter, and said pair of elongated rods are spaced a perpendicular distance less than the diameter so as to prevent the hose coupling end from slipping out between the rods in a direction transverse to the length of said elongated rods.

20. A method of coiling a fire hose, the method comprising the steps of:

(1) using a fire hose coiling apparatus comprised of, a main support extending generally vertically and having lower and upper opposed ends;

a hose reel having (1) an axle, wherein said axle is rotatably mounted to said upper end of said main support at an angle and has an axle distal end, and (2) a cross member including a center and a pair of spaced openings generally mutually spaced from the center;

a crank having first and second opposed ends, wherein said first end is releasably coupled to said axle distal end and said second end is configured to be gripped by a user for rotating said crank;

a retainer to couple a hose coupling end of the fire hose to said hose reel, said retainer including a handle and a pair of elongated rods each having a proximal end attached to said handle and a rod distal end, opposite said proximal end, configured to be received by one of said pair of spaced openings; and wherein said pair of elongated rods are spaced a perpendicular distance less than the width of the hose end of the fire hose to prevent the hose end from slipping out between the rods in a direction transverse to the length of said elongated rods;

(2) placing at least a portion of the fire hose between said pair of elongated rods;

(3) inserting said rod distal ends of said pair of elongated rods of said retainer into said pair of spaced openings;

(4) rotating said crank so as to cause the fire hose to coil to create a coiled fire hose; and (5) removing said retainer from said pair of spaced openings so as to cause the coiled fire hose to drop onto a catcher.

21. An apparatus for coiling a fire hose, the apparatus comprising:

a support;

a hose reel rotatably coupled to said support at an angle, said hose reel including (1) a rim defining a diameter, (2) a cross support having a length generally equal to the diameter and having opposed ends attached to said rim, and (3) an axle coupled to said cross support and having an axle distal end; and a retainer to couple the fire hose to said hose reel, said retainer including a handle and a pair of elongated rods each elongated rod having a proximal end attached to said handle and a rod distal end opposite said proximal end.

* * * * *